US007933539B2

(12) United States Patent
Kubota et al.

(10) Patent No.: US 7,933,539 B2
(45) Date of Patent: Apr. 26, 2011

(54) TONER HOPPER, DEVELOPING UNIT AND IMAGE FORMING APPARATUS

(75) Inventors: Hiroshi Kubota, Kadoma (JP); Koichi Mihara, Fujiidera (JP); Hisashi Kunihiro, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 80 days.

(21) Appl. No.: 12/416,286

(22) Filed: Apr. 1, 2009

(65) Prior Publication Data

US 2009/0252539 A1 Oct. 8, 2009

(30) Foreign Application Priority Data

Apr. 3, 2008 (JP) ..... 2008-097186

(51) Int. Cl.
*G03G 15/08* (2006.01)

(52) U.S. Cl. ..... 399/258; 399/263

(58) Field of Classification Search ..... 399/107, 399/119, 120, 252–258, 262, 263
See application file for complete search history.

(56) References Cited

U.S. PATENT DOCUMENTS

| | | | | |
|---|---|---|---|---|
| 5,629,758 | A | 5/1997 | Kageyama | |
| 7,319,828 | B2 * | 1/2008 | Takesawa et al. | 399/27 |

FOREIGN PATENT DOCUMENTS

| | | | |
|---|---|---|---|
| JP | 61-169422 | A | 7/1986 |
| JP | 5-61351 | | 3/1993 |
| JP | 5-127525 | A | 5/1993 |
| JP | 2006-235255 | A | 9/2006 |
| JP | 2007-34340 | * | 2/2007 |
| JP | 2008-040269 | A | 2/2008 |

* cited by examiner

*Primary Examiner* — Hoan Tran
(74) *Attorney, Agent, or Firm* — Nixon & Vanderhye, PC

(57) ABSTRACT

A toner hopper contains toner supplied from a toner container and supplies the toner to a developing device. The toner hopper includes: a container tank for containing the toner; a carrying screw which is disposed in the container tank and is rotated so as to carry the toner in the container tank; and an elastic member having a first section which is fixed to the container tank and a second section which comes into contact with the carrying screw, the first section being farther from the carrying screw than the second section in a direction perpendicular to an axis line of the carrying screw. According to the arrangement, it is possible to stabilize an amount of toner supplied from the toner hopper to the developing device.

10 Claims, 7 Drawing Sheets

TONER HOPPER, DEVELOPING UNIT AND IMAGE FORMING APPARATUS

This Nonprovisional application claims priority under 35 U.S.C. §119(a) on Patent Application No. 2008-097186 filed in Japan on Apr. 3, 2008, the entire contents of which are hereby incorporated by reference.

TECHNICAL FIELD

The present technology relates to a toner hopper for temporarily storing toner for use in an electrophotographic image forming apparatus, and also relates to a developing unit and an image forming apparatus, each of which includes the toner hopper.

BACKGROUND ART

Conventionally, an electrophotographic image forming apparatus such as a copying machine, a multifunction printer, a printer, and a facsimile has been known. The image forming apparatus forms an electrostatic latent image on a surface of a toner image bearing member (photoreceptor), develops the electrostatic latent image with the use of toner supplied from a developing device, and transfers and fixes thus obtained toner image onto a sheet such as paper.

In the image forming apparatus, a developer is stirred and circulated in the developing device so that a two-component developer (also referred to as developer) including toner and carrier are rubbed together and triboelectrically charged. At a developing stage, the toner thus triboelectrically charged moves, due to an electrostatic force, towards the electrostatic latent image formed on the toner image bearing member. Thus, a toner image is formed. Note that a developer contains toner of at least three colors in a color image forming apparatus.

Further, toner which can be fixed on a sheet at a relatively low temperature (toner having a lower melting point) has been developed in response to a demand in a market for improvement in energy conservation. However, in a small-sized image forming apparatus, toner is easily affected by heat from a heat source such as a fixing device. Therefore, in a case where toner having a lower melting point is used in such an image forming apparatus, it is more likely that aggregation and blocking of the toner occur. This causes deterioration in fluidity of the toner. Therefore, a toner-carrying performance is damaged in a small-sized image forming apparatus.

In order to solve this problem, techniques for securing the toner-carrying performance have been developed. For example, Patent Document 1 discloses a toner carrying device including a loosening member which is rotatably provided in a predetermined position of a toner carrying path leading up to a developing device and is configured to loose a soft blocking toner lump.

CITATION LIST

Patent Document 1

Japanese Patent Application Publication, Tokukaihei, No. 8-30097 A (Publication Date: Feb. 2, 1996)

Further, in recent years, a main-stream image forming apparatus is a tandem-type image forming apparatus. The tandem-type image forming apparatus includes a plurality of image forming sections, and is configured to once transfer developed images in the image forming sections onto an intermediate transfer belt and then transfer the thus-transferred developed images onto a sheet all at the same time. Further, because an image forming apparatus is reduced in size, it is difficult to secure a space for disposing devices for carrying out processes in image formation. In view of this, the image forming apparatus has an arrangement such that an intermediate transfer belt is disposed between a developing device and a toner container (also referred to as toner cartridge or toner bottle).

With this arrangement, it is more likely that toner drops onto the developing device directly from the toner container. Therefore, it is difficult to keep an amount of supplied toner at a constant level. Therefore, in many cases, a precise amount of toner is supplied by including an arrangement such that: an intermediate toner hopper is provided between the toner container and the developing device; toner contained in the toner container is sent to the intermediate toner hopper; and then the toner is supplied from the intermediate toner hopper to the developing device.

However, in a case where an intermediate toner hopper is further provided in an image forming apparatus which is reduced in size, it is mandatory that the intermediate toner hopper is significantly reduced in size, as a matter of course. Therefore, the intermediate toner hopper is easily affected by heat and is easily heated to a high temperature. Accordingly, it is more likely that blocking and aggregation of toner in the intermediate toner hopper occur. Consequently, toner adheres to constituent members of the intermediate toner hopper and accumulates over a period of time in operation.

The following description deals with this problem with reference to drawings. FIG. 6 is a perspective view illustrating a part of a conventional intermediate toner hopper 422. Toner in a toner container is supplied to a toner container tank 520 of the intermediate toner hopper 422 via a toner supply opening 521.

The toner thus supplied is carried in a G direction by a toner carrying member 522*a*. Then, the toner is guided in an H direction by a wall surface 520*b* of the toner container tank 520. Further, the toner is carried in a K direction (direction reverse to the G direction) by a toner carrying member 522*b*. The toner thus carried in the K direction reaches a toner discharge opening 523 (part indicated by the dotted line) provided on the bottom of the toner container tank 520. Subsequently, the toner is discharged from the toner discharge opening 523, and drops in a developing device.

However, when the intermediate toner hopper 422 is heated to a high temperature, toner adheres to outer peripheral surfaces of shafts of the toner carrying members 522*a* and 522*b*. This deteriorates an amount of toner carried by each of the toner carrying members 522*a* and 522*b*. As a result, an amount of toner supplied to the developing device may become less than a target amount that is to be supplied (it becomes difficult to supply toner at a constant amount).

This state is illustrated in FIGS. 7(*a*) and 7(*b*). FIG. 7(*b*) is a view schematically illustrating a cross section of the intermediate toner hopper 422, the cross section being taken along line B-B' of FIG. 7(*a*). As is clear from FIG. 7(*b*), toner T adheres to the outer peripheral surfaces of the shafts of the toner carrying members 522*a* and 522*b*. As a result, it seems that diameters of the shafts become larger. Like this, in a case where toner adheres to the toner carrying members 522*a* and 522*b* in the intermediate toner hopper 422, a toner-carrying performance deteriorates. Therefore, an amount of toner supplied to the developing device becomes less than a target amount that is to be supplied, and a toner concentration in the developing device deteriorates. Thus, a high developing performance cannot be attained.

SUMMARY OF TECHNOLOGY

The present technology is accomplished in view of the above problems. An object is to provide a toner hopper that can supply a steady amount of toner to a developing device.

In order to attain the above object, a toner hopper for containing toner supplied from a toner container and for supplying the toner to a developing device, includes: a container tank for containing the toner; a carrying screw which is provided in the container tank and is rotated so as to carry the toner in the container tank; and an elastic member having a first section which is fixed to the container tank and a second section which comes into contact with the carrying screw, the first section being provided farther from the carrying screw than the second section in a direction perpendicular to an axis line of the carrying screw.

With this arrangement, it is possible to rub the elastic member against the carrying screw which is being rotated, while rotation of the carrying screw is not hindered. This makes it possible to prevent toner from adhering to the carrying screw. Therefore, it is possible to prevent deterioration in an amount of toner carried in the toner hopper. Consequently, it becomes possible to stabilize an amount of toner supplied to the developing device.

For a fuller understanding of the nature and advantages of the technology, reference should be made to the ensuing detailed description taken in conjunction with the accompanying drawings.

BRIEF DESCRIPTION OF DRAWINGS

FIG. 1 is a view schematically illustrating an internal structure of a multifunction printer.

FIG. 2 is a view illustrating a toner bottle, which view is obtained when the toner bottle is viewed from above the multifunction printer.

FIG. 3 is a view schematically illustrating a cross section of a developing unit provided in the multifunction printer shown in FIG. 1.

FIG. 4(*a*) is a view illustrating a part of an intermediate toner hopper, which view is obtained when the intermediate toner hopper is viewed from above. FIG. 4(*b*) is a view schematically illustrating a cross section of the intermediate toner hopper, the cross section being taken along line A-A' of FIG. 4 (*a*).

FIG. 5(*a*) is a top view illustrating an elastic member attached to the intermediate toner hopper. FIG. 5(*b*) is a side view illustrating the elastic member shown in FIG. 5(*a*).

FIG. 6 is a perspective view illustrating a part of a conventional intermediate toner hopper.

FIG. 7(*a*) is a top view illustrating the conventional intermediate toner hopper. FIG. 7(*b*) is a view schematically illustrating a cross section of the intermediate toner hopper shown in FIG. 7(*a*), the cross section being taken along line B-B' of FIG. 7(*a*).

DESCRIPTION OF EMBODIMENTS

An embodiment is described below with reference to drawings. First, a multifunction printer (image forming apparatus) of the present embodiment is explained. Next, a developing unit provided in the multifunction printer is explained. Subsequently, an intermediate toner hopper provided in the developing unit is explained.

(Image Forming Apparatus)

Figure 1:
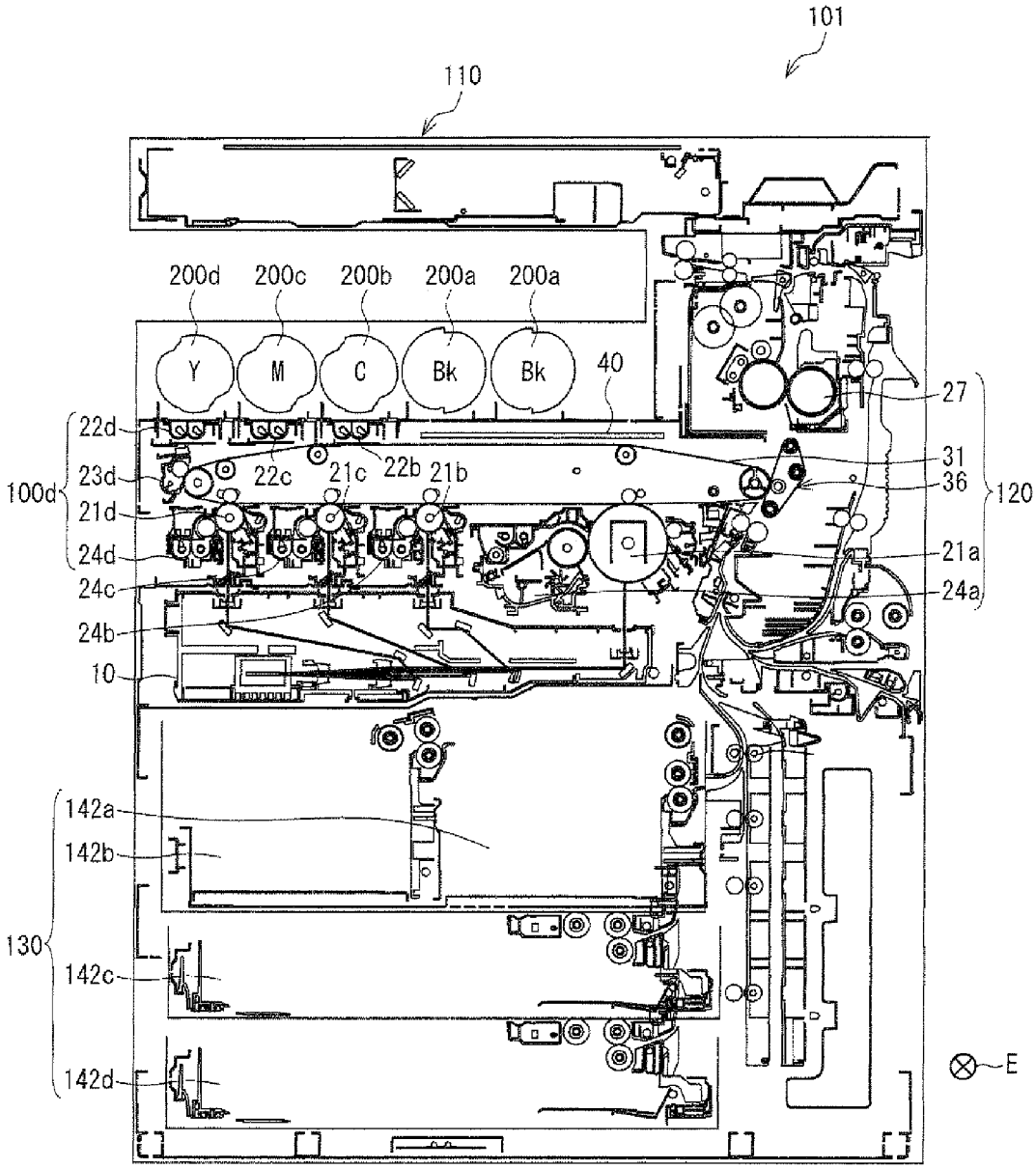
FIG. 1

FIG. 1 is a view schematically illustrating an internal structure of a multifunction printer of the present embodiment. The present embodiment discusses a multifunction printer as an example of an image forming apparatus. However, an image forming apparatus is not limited to a multifunction printer, but may be any device, such as a printer, a facsimile, or a copying machine, that is capable of forming an image according to an electrophotographic printing method.

A multifunction printer (image forming apparatus) 101 of the present embodiment forms, according to the electrophotographic method, a multicolor image or a monochromatic image on recording paper on the basis of a printing job transmitted from an information processing apparatus (not shown) such as a personal computer which is externally connected or on the basis of image data obtained by reading a document with the use of a document reading unit 110.

As shown in FIG. 1, the multifunction printer 101 mainly includes the document reading unit 110, an image forming unit (image forming section) 120, and a paper feeding unit 130. The paper feeding unit 130 includes four paper cassettes 142*a* through 142*d* in which recording paper is stored. The image forming unit 120 forms, according to the electrophotographic method, an image on recording paper supplied from any one of the paper cassettes of the paper feeding unit 130. The document reading unit 110 scans a document placed on a scanner platen so as to create image data.

The image forming unit 120 superimposes toner images of black (BK), cyan (C), magenta (M), and yellow (Y) one over the other so as to form a multicolor image. Therefore, the image forming unit 120 includes four photoreceptor drums 21*a* through 21*d* which correspond to BK, C, M, and Y, respectively. Further, the image forming unit 120 is provided with a charging device, a developing device, a first transfer roller, and a cleaning member around each of the photoreceptor drums 21*a* through 21*d*. In this way, the image forming unit 120 is arranged to be a tandem-type color image forming unit.

The image forming unit 120 further includes an exposure unit 10, an intermediate transfer belt 31, a second transfer device 36, a fixing device 27, and the like. Each of the photoreceptor drums 21*a* through 21*d* is, for example, an organic photoreceptor using an organic photo conductor (OPC).

The exposure unit 10 includes a laser scanning unit, a polygon mirror, an fθ lens, a reflection mirror, and the like. In the exposure unit 10, a laser beam emitted from the laser scanning unit passes through the polygon mirror and the fθ lens, is reflected by the reflection mirror, and then is thrown onto the photoreceptor drums 21*a* through 21*d* for respective colors.

Each of developing devices 24*a* through 24*d* includes a developing tank, a stirring roller, a developing roller, a doctor blade, and the like. Further, each of the developing devices 24*a* through 24*d* is provided with two carrying screws within the developing tank. Each of the developing devices 24*a* through 24*d* is general developing means for developing an image with the use of a two-component developer in which carrier is mixed with toner.

Each of the developing devices 24*a* through 24*d* develops an image by (i) mixing toner supplied into the developing tank with carrier with the use of the stirring roller, (ii) forming, on the developing roller, a magnetic brush whose height has been appropriately adjusted by the doctor blade, and (iii)

transferring toner adhering to the magnetic brush to a corresponding one of the photoreceptor drums 21*a* through 24*d* under a developing bias.

Further, in order to supply toner having different colors to the developing devices 24*a* through 24*d*, respectively, the multifunction printer 101 includes, above the developing devices 24*a* through 24*d*, toner bottles (toner containers) 200*a* through 200*d*, intermediate toner hoppers (toner hoppers) 22*a* through 22*d*, and toner relaying pipes 23*a* through 23*d*. Note that the intermediate toner hopper 22*a* and the toner relaying pipes 23*a* through 23*c* are provided on a far side of the intermediate transfer belt 31, and therefore are not shown in FIG. 1.

The toner bottle 200*a* contains black toner; the toner bottle 200*b* contains cyan toner; the toner bottle 200*c* contains magenta toner; and the toner bottle 200*d* contains yellow toner. Each of the toner bottles 200*a* through 200*d* can be replaced with a replacement toner bottle when toner has run out. Note that the multifunction printer 101 includes two toner bottles 200*a* for black toner which is consumed in a large amount. Further, each of the toner bottles 200*a* through 200*d* may contain a small amount of carrier in addition to the black, cyan, magenta, or yellow toner.

The intermediate toner hopper 22*a* through 22*d* temporarily store toner supplied from the toner bottles 200*a* through 200*d*, respectively. Note that the intermediate toner hopper 22*a* receives toner from the two toner bottles 200*a*. Further, the intermediate toner hoppers 22*a* through 22*d* supply toner contained therein to the developing devices 24*a* through 24*d* via the toner relaying pipes 23*a* through 23*d* at appropriate timings, respectively.

Figure 3:
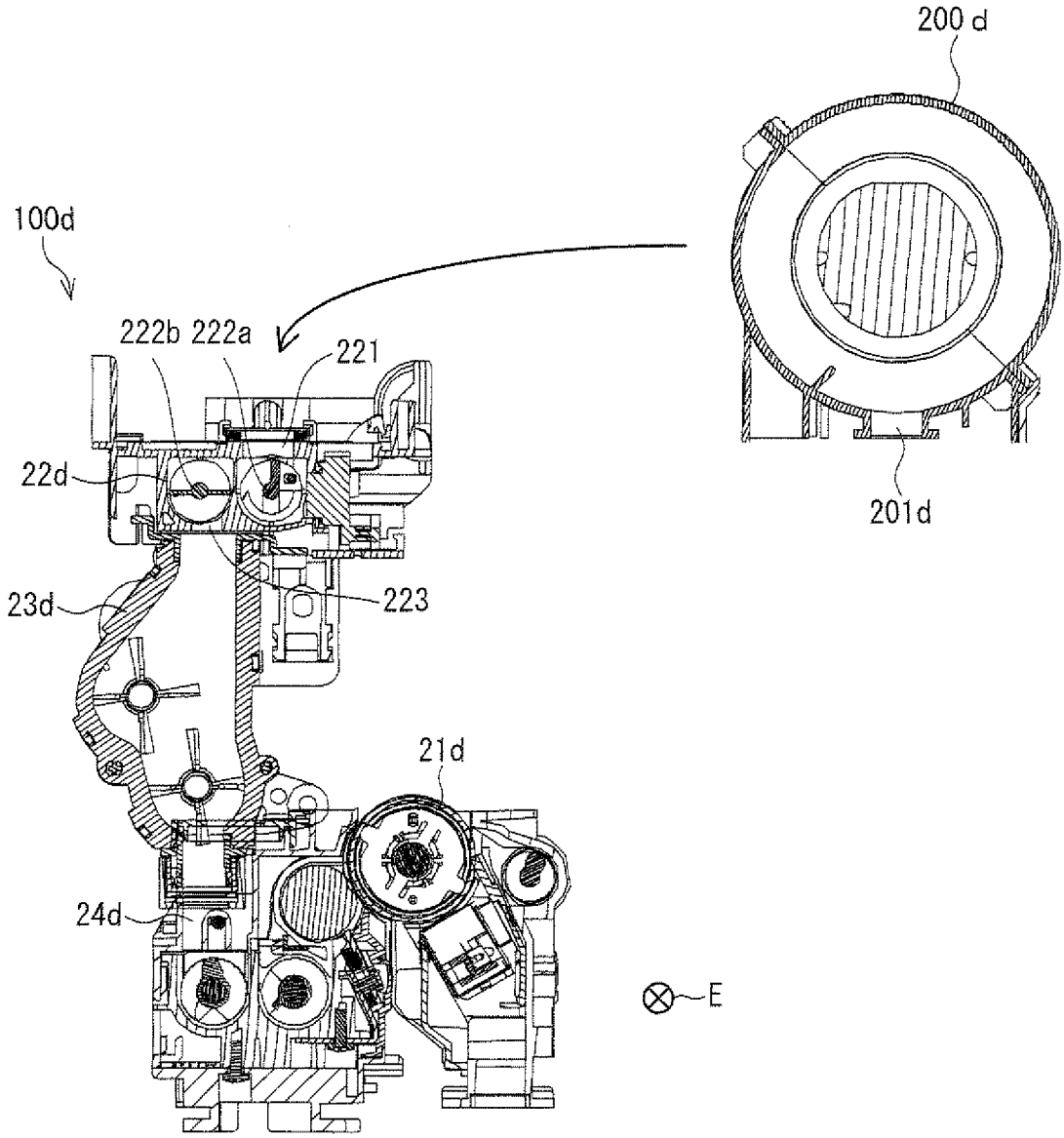
FIG. 3

The toner relaying pipes 23*a* through 23*d* are toner carrying paths connecting the intermediate toner hoppers 22*a* through 22*d* with the developing devices 24*a* through 24*d*, respectively. For example, as shown in FIG. 3, the toner relaying pipe 23*d* for yellow toner connects the intermediate toner hopper 22*d* with the developing device 24*d*.

According to the above arrangement, toner contained in the toner bottles 200*a* is supplied to the developing device 24*a* via the intermediate toner hopper 22*a* and the toner relaying pipe 23*a* in this order; toner contained in the toner bottle 200*b* is supplied to the developing device 24*b* via the intermediate toner hopper 22*b* and the toner relaying pipe 23*b* in this order; toner contained in the toner bottle 200*c* is supplied to the developing device 24*c* via the intermediate toner hopper 22*c* and the toner relaying pipe 23*c* in this order; and toner contained in the toner bottle 200*d* is supplied to the developing device 24*d* via the intermediate toner hopper 22*d* and the toner relaying pipe 23*d* in this order.

The intermediate transfer belt 31 is an endless belt provided in a tensioned state by a driving roller and a driven roller, and comes in contact with respective surfaces of the photoreceptor drums 21*a* through 21*d*. Further, the intermediate transfer belt 31 comes in contact with a paper carrying path. A belt member of the second transfer device 36 is provided so as to face the intermediate transfer belt 31, in a section at which the intermediate transfer belt 31 comes in contact with the paper carrying path.

The fixing device 27 includes a fixing roller and a pressure roller. These two rollers sandwich recording paper on which a toner image has been transferred so as to fix the toner image on the recording paper.

The following description deals with an image forming process in the multifunction printer 101. First, the surfaces of the photoreceptor drums 21*a* through 21*d* are uniformly charged by the charging devices, respectively. Next, thus uniformly charged areas on the surfaces of the photoreceptor drums 21*a* through 21*d* are subjected to exposure by the exposure unit 10 so that electrostatic latent images are formed on the surfaces of the photoreceptor drums 21*a* through 21*d*, respectively. These electrostatic latent images are formed for respective color components included in an image.

The respective electrostatic latent images of the color components, respectively, formed on the surfaces of the photoreceptor drums 21*a* through 21*d* are developed by the developing devices 24*a* through 24*d*, respectively. Thus, toner images of BK, C, M and Y are formed on the surfaces of the photoreceptor drums 21*a* through 21*d*, respectively.

The toner images of BK, C, M and Y which are respectively formed on the surfaces of the photoreceptor drums 21*a* through 21*d* are transferred onto the intermediate transfer belt 31 so that the toner images are superimposed. As a result, a desired multicolor image is formed as a toner image on the intermediate transfer belt 31.

Meanwhile, recording paper is picked up one by one from any one of the paper cassettes of the paper feeding unit 130 and carried through the paper carrying path. The recording paper thus carried reaches a point at which the belt member of the second transfer device 36 is provided. At this point, the recording paper is pressured against the intermediate transfer belt 31 by the belt member of the second transfer device 36. Here, a transfer electric field is formed between the second transfer device 36 and the intermediate transfer belt 31. The transfer electric field allows the toner image formed on the intermediate transfer belt 31 to be transferred onto the recording paper.

The recording paper onto which the toner image has been transferred is further carried to the fixing device 27, and the fixing device 27 fixes the toner image on the recoding paper. When the recording paper is outputted to a paper output tray, the image forming process is completed.

(Developing Unit)

Further, in the present embodiment, a toner bottle, an intermediate toner hopper, a toner relaying pipe, and a developing device are collectively referred to as a developing unit. The multifunction printer 101 includes a developing unit handling black toner, a developing unit handling cyan toner, a developing unit handling magenta toner, and a developing unit handling yellow toner.

That is, the multifunction printer 101 includes (i) a developing unit 100*a* which handles black toner and includes the toner bottle 200*a*, the intermediate toner hopper 22*a*, the toner relaying pipe 23*a*, and the developing device 24*a*; (ii) a developing unit 100*b* which handles cyan toner and includes the toner bottle 200*b*, the intermediate toner hopper 22*b*, the toner relaying pipe 23*b*, and the developing device 24*b*; (iii) a developing unit 100*c* which handles magenta toner and includes the toner bottle 200*c*, the intermediate toner hopper 22*c*, the toner relaying pipe 23*c*, and the developing device 24*c*; and (iv) a developing unit 100*d* which handles yellow toner and includes the toner bottle 200*d*, the intermediate toner hopper 22*d*, the toner relaying pipe 23*d*, and the developing device 24*d*.

Figure 2:
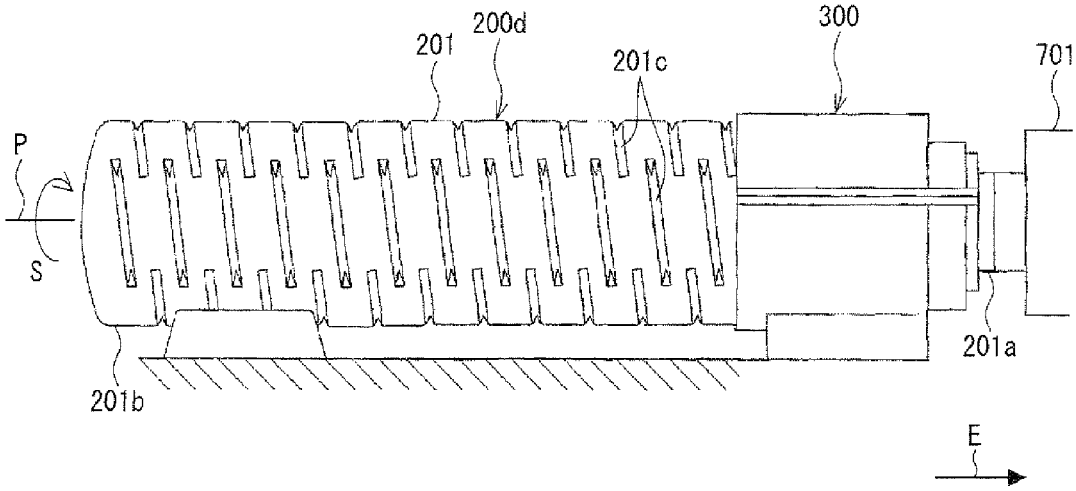
FIG. 2

Note that the following explanation deals with only the developing unit 100*d*, but explanations of the developing units 100*a* through 100*c* are omitted. However, the explanation concerning the developing unit 100*d* also applies to the developing units 100*a* through 100*c*. FIG. 2 is a view illustrating the toner bottle 200*d* which view is obtained when the toner bottle 200*d* is viewed from above the multifunction printer 101. FIG. 3 is a view illustrating a cross section of the developing unit 100*d*, the cross section being taken from a deep side of the multifunction printer 101. In FIG. 3, the toner bottle 200*d* is illustrated separately from the developing unit

100*d*, for convenience of explanation. However, in reality, the toner bottle 200*d* is inserted into the multifunction printer 101 from a front side to the deeper side of the multifunction printer 101 so as to be provided above the intermediate toner hopper 22*d*. Note that an E direction shown in the figures is parallel to an insertion direction of the toner bottle 200*d*.

As shown in FIGS. 2 and 3, the developing unit 100*d* includes (i) the toner bottle (toner container) 200*d* in which toner that is a component of a developer is stored and (ii) a bottle holding member 300 for holding the toner bottle 200*d* at one end section of the toner bottle 200*d*.

The toner bottle 200*d* has a cylinder section 201 having a substantially cylindrical shape. As shown in FIG. 2, the toner bottle 200*d* is inserted into the multifunction printer 101 so that an axis line P of the cylinder section 201 and the E direction are parallel to each other. Further, the toner bottle 200*d* is held by the bottle holding member 300 so as to be rotatable in an S direction on the axis line P as an axis of rotation. Provided that an end section of the cylinder section 201 which end section is held by the bottle holding member 300 is referred to as a head end section 201*a*, a discharge opening 201*d* (see FIG. 3) for discharging toner is provided in the vicinity of the head end section 201*a*. Note that the discharge opening 201*d* is not shown in FIG. 2 because an outer peripheral surface of the cylinder section 201 is covered with the bottle holding member 300 in the vicinity of the discharge opening 201*d*. Meanwhile, in the toner bottle 200*d*, the cylinder section 201 has a rear end section 201*b* that is an opposite side of the head end section 201*a*. The rear end section 201*b* has no opening.

The cylinder section 201 has an outer peripheral surface provided with a plurality of grooves 201*c* each depressed towards the inner side of the cylinder section 201. Meanwhile, on an inner peripheral surface of the cylinder section 201, regions corresponding to the grooves 201*c* form projections protruding towards the axis line P.

The grooves 201*c* are formed so as to extend in a direction slightly slanting with respect to a line perpendicular to the axis line P. Further, directions in which the grooves 201*c* extend are parallel to one another, and the grooves 201*c* are formed along the axis line P so as to be parallel to one another. Therefore, the projections respectively corresponding to the grooves 201*c* are provided in a spiral manner on the inner peripheral surface of the toner bottle 200*d*. Note that the toner bottle 200*d* which has the grooves 201*c* is formed, for example, by molding an HDPE (High-Density Polyethylene) resin with the use of a metal mold.

The toner bottle 200*d* is inserted into the multifunction printer 101 so that the axis line P of the cylinder section 201 becomes horizontal. The toner bottle 200*d* is driven by a rotation driving unit 701 shown in FIG. 2 so as to rotate in the S direction on the axis line P as an axis of rotation.

When the toner bottle 200*d* is driven to rotate, toner contained in the toner bottle 200*d* is guided by the projections which respectively correspond to the grooves 201*c*, and carried from a rear end section 201*b* side towards a head end section 201*a* side at which the discharging opening 201*d* is provided. When the toner reaches the discharging opening 201*d* formed in the vicinity of the head end section 201*a*, the toner is discharged from the toner bottle 200*d* into the bottle holding member 300. Then, the toner is supplied from a bottom part of the bottle holding member 300 to the intermediate toner hopper 22*d*.

Further, the toner thus supplied from the toner bottle 200*d* to the intermediate toner hopper 22*d* is temporarily stored in the intermediate toner hopper 22*d*. Subsequently, the toner in the intermediate toner hopper 22*d* drops into the toner relaying pipe 23*d* and is carried into the developing device 24*d* through the toner relaying pipe 23*d*. The toner thus carried into the developing device 24*d* is mixed into a developer. The developer thus mixed with the toner is stirred and carried backwards and forwards in a longitudinal direction (direction parallel to the E direction), and is used in developing an electrostatic latent image formed on the photoreceptor drum 21*d*. Note that each of the grooves 201*c* is not limited to a specific shape as long as toner contained in the cylinder section 201 can be carried from the rear end section 201*b* side towards the head end section 201*a* side.

(Intermediate Toner Hopper)

Figure 4:
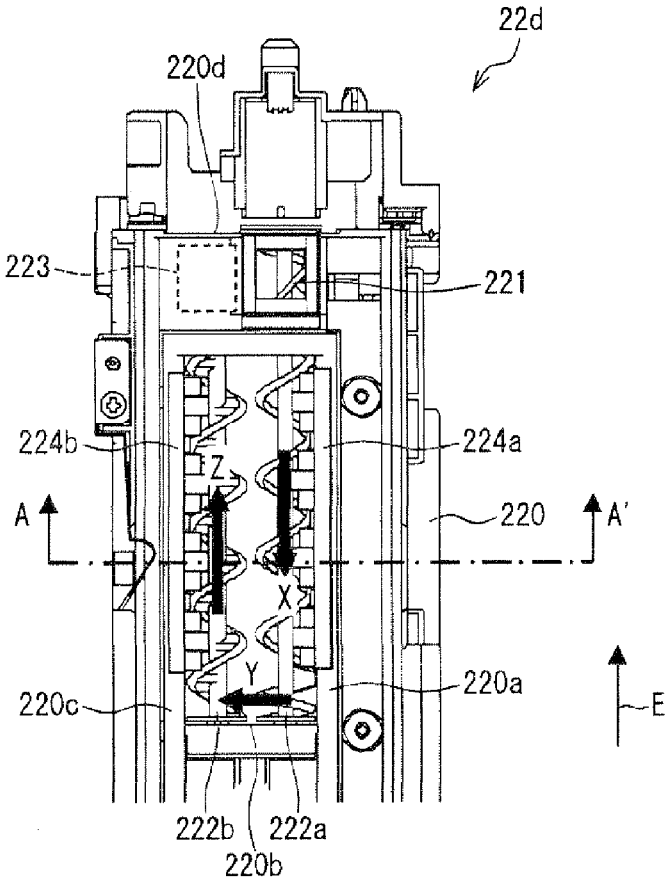
FIG. 4
Figure 4:
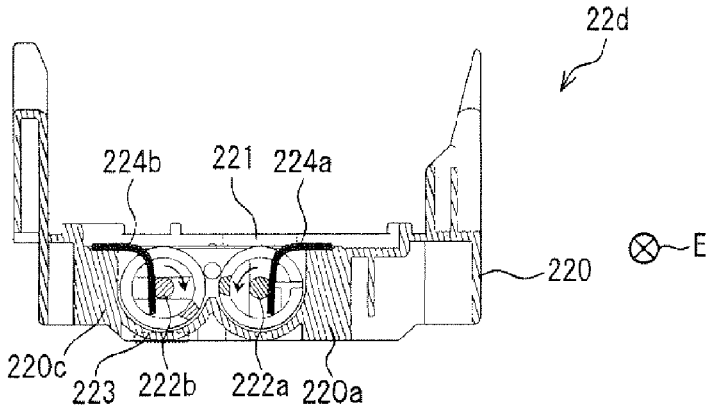

The following description deals with the intermediate toner hopper 22*d* provided in the developing unit 100*d*. FIG. 4(*a*) is a view illustrating a part of the intermediate toner hopper 22 (an end section side in the E direction), which view is obtained when the intermediate toner hopper 22 is viewed from above. FIG. 4(*b*) is a view schematically illustrating a cross section of the intermediate toner hopper 22*d* shown in FIG. 4(*a*), the cross section being taken along line A-A' of FIG. 4(*a*).

The intermediate toner hopper 22*d* has a container tank 220 in which toner discharged from the toner bottle 200*d* is temporarily stored. As shown in FIG. 4, the container tank 220 is provided with carrying screws 222*a* and 222*b* therein. Note that hereinafter the carrying screws 222*a* and 222*b* may be collectively referred to simply as a carrying screw 222.

The carrying screw 222 rotates so as to stir and carry toner in the container tank 220. The carrying screw 222 has shafts whose outer peripheral surfaces are respectively provided with ribs (stirring blades) each having a spiral shape. The shafts are driven by driving means (not shown) such as a motor so as to rotate, and the ribs are rotated in response to the rotation of the shafts so that the toner is stirred and carried.

As shown in FIGS. 4(*a*) and 4(*b*), the carrying screw 222*a* and the carrying screw 222*b* have shafts (i) whose peripheral surfaces face each other and (ii) whose axis lines are parallel to each other. The carrying screw 222*a* and the carrying screw 222*b* are set to rotate in directions reverse to each other. The carrying screw 222*a* carries toner in an X direction shown in FIG. 4(*a*), and the carrying screw 222*b* carries toner in a Z direction which is opposite to the X direction. Note that each of the X direction and the Z direction is parallel to the E direction. That is, the carrying screw 222 is disposed so that its axis line is parallel to the E direction.

Further, as shown in FIG. 4(*b*), the carrying screw 222 is rotated in a direction so that (i) toner flows downward in a region between the carrying screw 222*a* and the carrying screw 222*b*; (ii) toner flows upward in a region between a side wall 220*a* and the carrying screw 222*a*; and (iii) toner flows downward in a region between a side wall 220*c* and the carrying screw 222*b*. Thus, the toner is carried in a manner such that the toner present in the region between the carrying screw 222*a* and the carrying screw 222*b* is larger in amount than the toner present in the region between a side wall 220*a* and the carrying screw 222*a* or the toner present in the region between a side wall 220*c* and the carrying screw 222*b*.

Further, as shown in FIG. 4(*a*), a toner supply opening 221 is formed on a top wall of the container tank 220 on an upstream side in the X direction. Toner discharged from the toner bottle 200*d* is supplied from the toner supply opening 221 into the container tank 220.

Further, as shown in FIG. 4, a toner discharging opening 223 is formed in a bottom section of the container tank 220 on a downstream side in the Z direction. Toner contained in the container tank 220 is discharged into the toner relaying pipe 23*d* via the toner discharging opening 223, and then is supplied to the developing device 24*d*.

The following description deals with how toner is carried in the container tank 220. In the container tank 220, the carrying screw 222 is driven by driving means (not shown) such as a motor so as to rotate. Here, the toner is discharged from the toner bottle 200*d*, which is being rotated, into the container tank 220 via the toner supply opening 221. Then, the toner is carried in the X direction while being stirred by the carrying screw 222*a*.

The toner carried by the carrying screw 222*a* reaches the vicinity of an inner wall surface 220*b* formed at an end section of the container tank 220 on a downstream side in the X direction. Further, the toner which has reached the vicinity of the inner wall surface 220*b* is guided in a Y direction by the carrying screw 222*a* so as to be carried to a peripheral area of the carrying screw 222*b*. Note that the Y direction is a direction from the carrying screw 222*a* to the carrying screw 222*b*.

Subsequently, the toner carried in the Y direction in the vicinity of the inner wall surface 220*b* is carried in the Z direction by the carrying screw 222*b*. Further, when the toner carried by the carrying screw 222*b* reaches the vicinity of an inner wall surface 220*d* on a downstream side in the Z direction (an upstream in the X direction) in the container tank 220, the toner is partially discharged from the toner discharging opening 223 into the toner relaying pipe 23*d*.

Further, toner which is not discharged from the toner discharging opening 223 among the toner which has reached the vicinity of the inner wall surface 220*d* is guided by the carrying screw 222*b* in a direction reverse to the Y direction so as to be carried to a peripheral area of the carrying screw 222*a*. The toner which has reached the peripheral area of the carrying screw 222*a* is carried in the X direction again.

That is, toner is carried so as to circulate in the container tank 220 of the intermediate toner hopper 22*d*. Further, toner is supplied from the toner supply opening 221 so as to be added to the toner that is being carried and circulated in the container tank 220, while the toner that is being carried and circulated in the container tank 220 is partially discharged from the toner discharging opening 223.

(Elastic Member)

Figure 5:
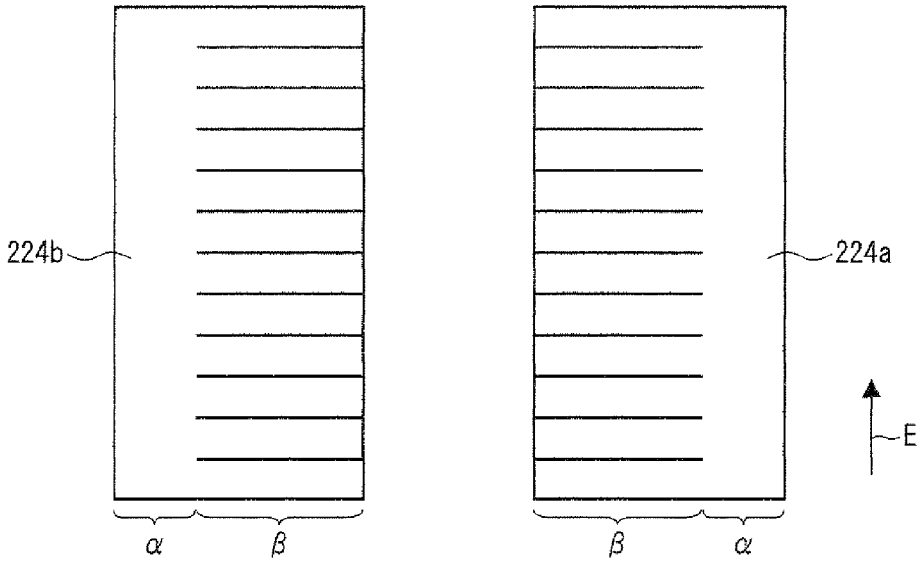
FIG. 5
Figure 5:
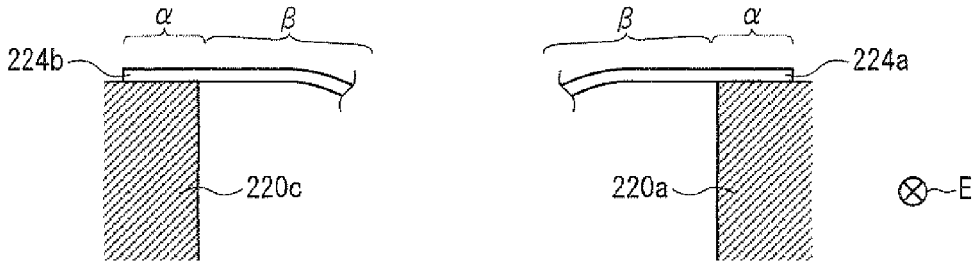
Figure 6:
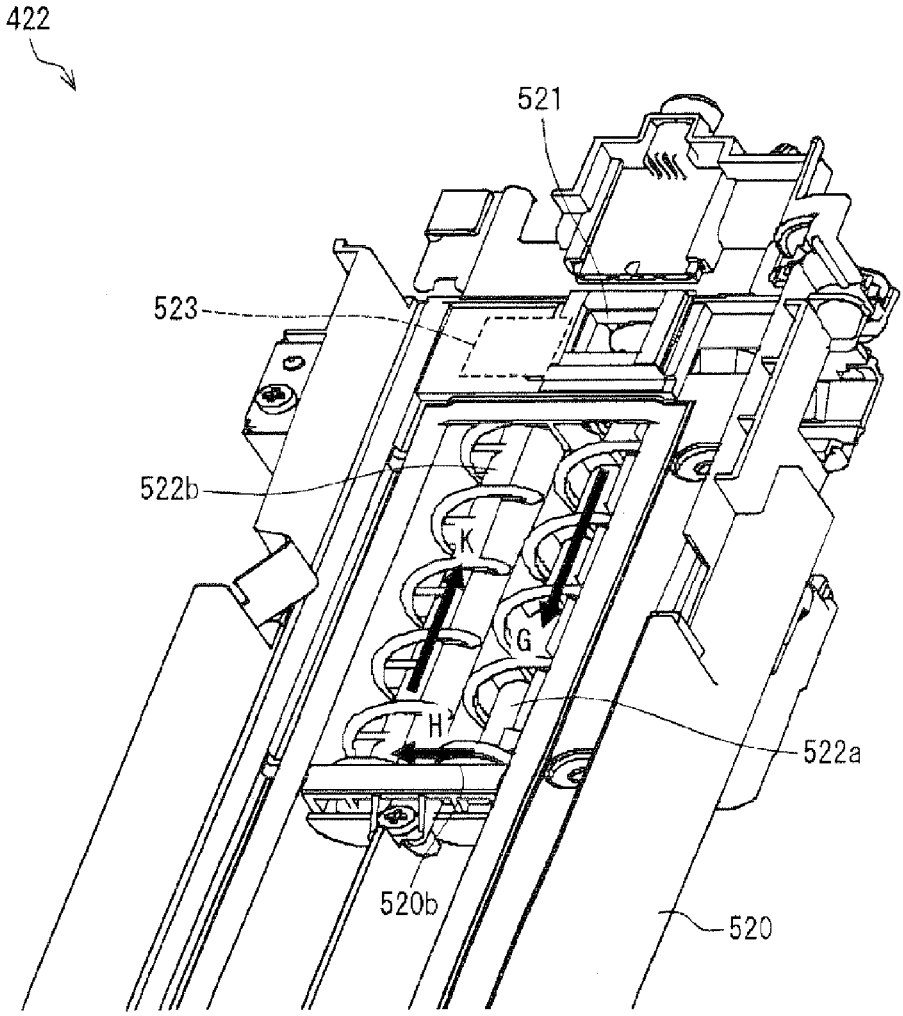
FIG. 6 (PRIOR ART)
FIG. 6
Figure 7:
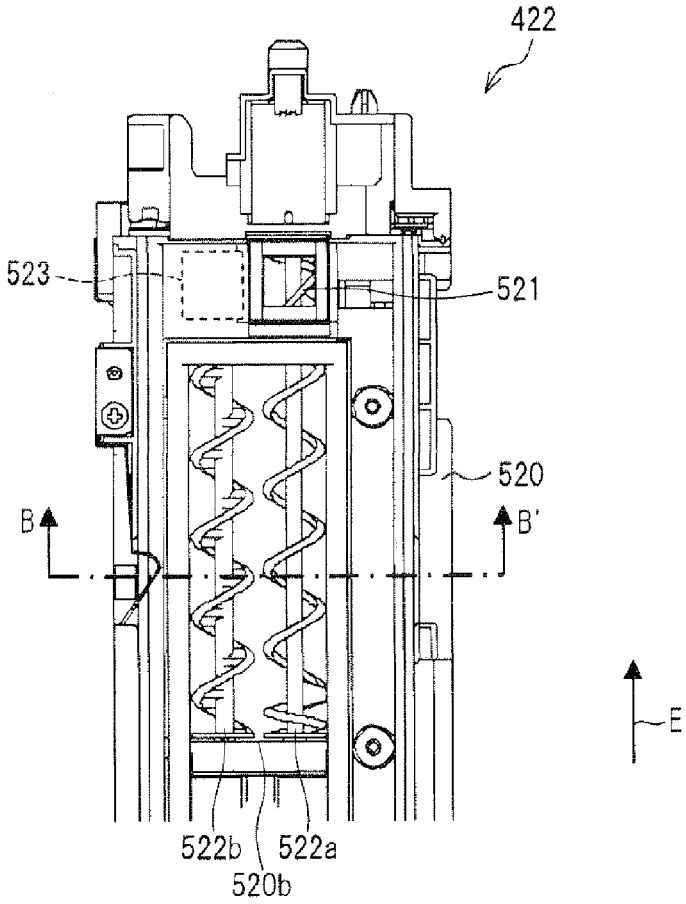
FIG. 7 (a) (PRIOR ART)
FIG. 7
Figure 7:
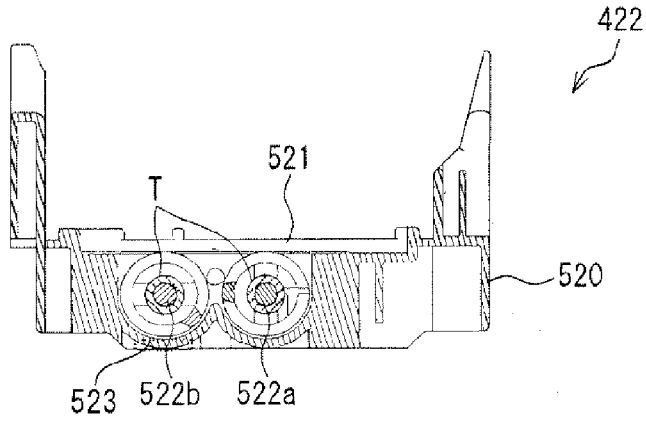
FIG. 7 (b) (PRIOR ART)

As shown in FIG. 4, the container tank 220 of the intermediate toner hopper 22*d* of the present embodiment is provided with elastic members 224*a* and 224*b*. The following description deals with the elastic members 224*a* and 224*b* in detail. FIG. 5(*a*) is a top view of the elastic members 224*a* and 224*b*, and FIG. 5(*b*) is a side view of the elastic members 224*a* and 224*b*. Note that hereinafter the elastic members 224*a* and 224*b* may be collectively referred to simply as an elastic member 224.

As shown in FIGS. 5(*a*) and 5(*b*), the elastic member 224 is made of a leaf spring which has a thickness of 1 mm and is formed into a strip shape. A material of the elastic member 224 is made of PET (polyethylene terephthalate). Further, the elastic member 224 is provided with a plurality of cuts extending from one long side towards the other long side in a short side direction which cuts do not reach the other long side. Further, the elastic member 224 is arranged such that the plurality of cuts are designed to be equally spaced (at an interval of 5 mm) in a long-side direction.

As shown in FIG. 5(*a*), a section of the elastic member 224 in which section no cut is formed in the long-side direction is referred to as a first section α, and a section of the elastic member 224 in which section the cuts are formed side by side in the long-side direction is referred to as a second section β.

As shown in FIGS. 4 and 5, a rear surface of the first section α of the elastic member 224*a* is adhered to a top surface of the side wall 220*a* of the container tank 220 so that: (i) the long-side direction of the elastic member 224*a* and an axis line direction of the carrying screw 222*a* are parallel (or substantially parallel) to each other; and (ii) the second section β of the elastic member 224*a* projects from the side wall 220*a* into the inside of the container tank 220. Note that the elastic member 224*a* and the side wall 220*a* are adhered to each other with the use of a double-faced tape.

Further, the elastic member 224*a* is bent so that a surface of the second section β presses the carrying screw 222*a* by use of an elastic force of the elastic member 224*a*. (That is, the elastic member 224*a* is designed so as to have a size that allows the elastic member 224*a* to come in contact with the carrying screw 222*a*, while being adhered to the side wall 220*a*.)

Therefore, the elastic member 224*a* is attached to the side wall 220*a* so that: (i) the first section α is farther from the carrying screw 222*a* than the second section β in a direction perpendicular to the axis line of the carrying screw 222*a*; and (ii) directions of the cuts made in the second section 13 of the elastic member 224*a* are substantially perpendicular to the axis line direction of the carrying screw 222*a*.

Further, as shown in FIGS. 4 and 5, a rear surface of the first section α of the elastic member 224*b* is adhered to a top surface of the side wall 220*c* of the container tank 220 so that: (i) the long-side direction of the elastic member 224*b* and an axis line direction of the carrying screw 222*b* are parallel to each other; and (ii) the second section β of the elastic member 224*b* projects from the side wall 220*c* into the inside of the container tank 220. Note that the elastic member 224*b* and the side wall 220*c* are adhered to each other with the use of a double-faced tape.

Further, the elastic member 224*b* is bent so that a surface of the second section β presses the carrying screw 222*b* by use of an elastic force of the elastic member 224*b*. (That is, the elastic member 224*b* is designed so as to have a size that allows the elastic member 224*b* to come in contact with the carrying screw 222*b*, while being adhered to the side wall 220*c*.)

Therefore, the elastic member 224*b* is attached to the side wall 220*c* so that: (i) the first section α is farther from the carrying screw 222*b* than the second section β in a direction perpendicular to the axis line of the carrying screw 222*b*; and (ii) directions of the cuts made in the second section β of the elastic member 224*b* are substantially perpendicular to the axis line direction of the carrying screw 222*b*.

In a case where the elastic member 224 is attached to the container tank 220 in such a manner, (i) the carrying screw 222*a* is rubbed by the elastic member 224*a* as the carrying screw 222*a* rotates, and (ii) the carrying screw 222*b* is rubbed by the elastic member 224*b* as the carrying screw 222*b* rotates. Therefore, when the toner supplied via the toner supply opening 221 is carried in the X direction by the rotation of the carrying screw 222*a*, the elastic member 224*a* prevents toner from adhering to the carrying screw 222*a* even if an intermediate hopper is heated to a high temperature. Further, when the toner having carried in the X direction is made to turn back by the inner wall surface 220*b* and carried in the Z direction by the rotation of the carrying screw 222*b*, the elastic member 224*b* prevents the toner from adhering to the carrying screw 222*b*.

That is, as shown in FIGS. 4 and 5, the elastic member 224 is arranged such that: (i) the first section α is provided farther from the carrying screw 222 than the second section β in the direction perpendicular to the axis line of the carrying screw 222 and is fixed to the container tank 220; and (ii) the second section β is provided nearer to the carrying screw 222 than the first section α in the direction perpendicular to the axis line of the carrying screw 222 and comes in contact with the carrying screw 222. Therefore, it is possible to rub the elastic member 224 against the carrying screw 222 which is being rotated, while the rotation of the carrying screw 222 is not hindered. This can prevent toner from adhering to the carrying screw 222. As a result, it becomes possible to prevent deterioration in an amount of toner carried in the intermediate toner hopper 22*d*. This can stabilize an amount of toner to be supplied to the developing device 24*d*. Furthermore, in a case where an amount of the toner to be supplied to the developing device 24*d* is stabilized, it becomes possible, in the developing device 24*d*, (i) to achieve a uniform toner concentration, (ii) to stabilize a toner charge amount, and (iii) to keep a stable image-development quality.

Further, a section where toner is most likely to adhere in the carrying screw 222 is a shaft. Therefore, as shown in FIGS. 4 and 5, in the present embodiment, the second section β of the elastic member 224 is arranged to come in contact with the shaft of the carrying screw 222. This makes it possible to further prevent toner from adhering to the carrying screw 222.

Further, the elastic member 224 is made of a leaf spring which is bent so that the second section β of the elastic member 224 presses against the carrying screw 222. Therefore, while the carrying screw 222 is being rotated, the second section β of the elastic member 224 is moved (is deformed) by the elastic force of the elastic member 224 so as to (i) come into contact with the carrying screw 222 and (ii) be spaced apart from the carrying screw 222, alternately and repeatedly. In other words, the second section β repeatedly hits the carrying screw 222. Therefore, it is possible to intermittently rub the second section β of the elastic member 224 against the carrying screw 222 being rotated, while the rotation of the carrying screw 222 is not hindered.

Further, in the present embodiment, the elastic member 224 which is made of a leaf spring has a strip shape. This elastic member 224 is attached to the container tank 220 so that the long-side direction of the elastic member 224 and the axis line direction of the carrying screw 222 are parallel to each other. This makes it possible to reliably provide a large contact area between the carrying screw 222 and the elastic member 224. Accordingly, it becomes possible to reliably provide a large area of the carrying screw 222 which area is rubbed by the elastic member 224. Therefore, toner can be further prevented from adhering to the carrying screw 222.

Further, in the present embodiment, the elastic member 224 which is made of a leaf spring is provided with a plurality of cuts made in a direction substantially perpendicular (or perpendicular) to the axis line direction of the carrying screw 222. Therefore, even if the carrying screw 222 has a rib having a spiral shape, it is possible to reliably provide a large contact area between the carrying screw 222 and the elastic member 224. That is, it is possible to reliably provide an area of the carrying screw 222 which area is rubbed by the elastic member 224. Therefore, it is possible to further prevent toner from adhering to the carrying screw 222.

Further, the elastic member 224 is made of a leaf spring whose material is PET (polyethylene terephthalate). The material of the elastic member 224 is not limited to PET. The material may be metal or resin, provided that the material has elasticity. Examples of the material of the elastic member 224 are polycarbonate, polybutyl terephthalate, and polytetrafluoroethylene.

However, the elastic member 224 is preferably made of PET from a standpoint of durability of the elastic member 224 because PET has a high strength and a low reactivity with toner. Further, PET is superior to the other materials in easy manufacturing.

Furthermore, the carrying screw 222 of the present embodiment has a rib that is formed in a spiral shape on the shaft. With this arrangement, it is possible (i) to easily maintain, at a substantially constant level, an amount of toner carried in the intermediate toner hopper 22*d*, and (ii) to easily stabilize an amount of toner to be supplied to the developing device 24*d*.

Further, in the present embodiment, (i) the elastic member 224*a* is disposed between the side wall 220*a* and the carrying screw 222*a*, and (ii) the elastic member 224*b* is disposed between the side wall 220*c* and the carrying screw 222*b*. That is, each of the elastic members 224*a* and 224*b* is disposed not in a region in which toner flows downward but in a region in which toner flows upward. In other words, each of the elastic members 224*a* and 224*b* is disposed not in a region in which an amount of toner is relatively large but in a region in which an amount of toner is relatively small. This makes it possible to avoid a case where the elastic member 224 hinders toner carrying by the carrying screw 222.

Further, according to the toner hopper 22 of the present embodiment, the elastic member 224 comes in contact with both of the carrying screws 222*a* and 222*b*. This makes it possible to prevent toner from adhering to each of the carrying screws 222*a* and 222*b*. This can prevent a disadvantage such that life of the toner hopper 22 ends, in a case where a large amount of toner adheres to one carrying screw while toner does not adhere to the other carrying screw. (That is, it is possible to prevent a disadvantage such that life of the toner hopper 22 itself ends, when life of one carrying screw ends while life of the other carrying screw still can last long.)

In order to attain the above object, a toner hopper for containing toner supplied from a toner container and for supplying the toner to a developing device, includes: a container tank for containing the toner; a carrying screw which is provided in the container tank and is rotated so as to carry the toner in the container tank; and an elastic member having a first section which is fixed to the container tank and a second section which comes into contact with the carrying screw, the first section being provided farther from the carrying screw than the second section in a direction perpendicular to an axis line of the carrying screw.

With this arrangement, it is possible to rub the elastic member against the carrying screw which is being rotated, while rotation of the carrying screw is not hindered. This makes it possible to prevent toner from adhering to the carrying screw. Therefore, it is possible to prevent deterioration in an amount of toner carried in the toner hopper. Consequently, it becomes possible to stabilize an amount of toner supplied to the developing device.

In addition to the arrangement, a section where toner is most likely to adhere in the carrying screw is a shaft. Therefore, the elastic member is preferably arranged such that the second section of the elastic member comes into contact with a shaft of the carrying screw. With this arrangement, it is possible to further prevent toner from adhering to the carrying screw.

In addition to the arrangement, the toner hopper is preferably arranged such that the elastic member is made of a leaf spring; and the leaf spring is bent so that the second section presses against the carrying screw. With this arrangement, while the carrying screw is being rotated, the second section of the leaf spring moves by the elastic force of the elastic member so as to (i) come into contact with the carrying screw 222 and (ii) be spaced apart from the carrying screw 222, alternately and repeatedly. Therefore, it is possible to intermittently rub the leaf spring against the carrying screw being rotated, while the rotation of the carrying screw is not hindered.

In addition to the arrangement, the toner hopper is preferably arranged such that the leaf spring has a strip shape and is attached to the container tank so that a long-side direction of the leaf spring and an axis line direction of the carrying screw are substantially parallel to each other. With this arrangement, it is possible to reliably provide a large contact area between the carrying screw and the leaf spring. Accordingly, it becomes possible to reliably provide a large area of the carrying screw which area is rubbed by the leaf spring. Therefore, it is possible to further prevent toner from adhering to the carrying screw.

In addition to the arrangement, the toner hopper is preferably arranged such that the leaf spring is provided with a plurality of cuts made in a direction substantially perpendicular to an axis line direction of the carrying screw. With this arrangement, even if the carrying screw has a stirring blade formed in a part of the carrying screw or a stirring blade having a spiral shape, it is possible to reliably provide a large contact area between the carrying screw and the leaf spring. Accordingly, it becomes possible to reliably provide a large area of the carrying screw which area is rubbed by the leaf spring. Therefore, it is possible to further prevent toner from adhering to the carrying screw.

Further, the toner hopper is arranged such that the leaf spring is made of metal or resin. It is particularly preferable that the leaf spring is made of polyethylene terephthalate. This is because polyethylene terephthalate has a high strength and a low reactivity with toner.

In addition to the arrangement, the toner hopper of is preferably arranged such that the carrying screw has a rib formed on a shaft, the rib having a spiral shape. This is because, in a case where a carrying screw has a rib having a spiral shape, an amount of carried toner can be easily kept at a substantially constant level. Thus, such a carrying screw is suitably used in the toner hopper.

Further, due to rotation of the carrying screw, the toner flows upward and downward around the carrying screw while being carried. The toner tends to be distributed to a region in which the toner flows downward rather than to a region in which the toner flows upward. Accordingly, in addition to the arrangement, the toner hopper is preferably arranged such that the elastic member is provided not in a region in which the toner flows downward but in a region in which the toner flows upward. With this arrangement, it is possible to prevent a case where the elastic member hinders toner carrying by the carrying screw.

Further, the present technology may be a developing unit including the toner hopper, the toner container, and the developing device. Furthermore, the technology may be an image forming apparatus including the developing unit.

The technology is not limited to the description of the embodiments above, but may be altered by a skilled person within the scope of the claims. An embodiment based on a proper combination of technical means disclosed in different embodiments is encompassed in the scope of the technology.

The embodiments and concrete examples of implementation discussed in the foregoing detailed explanation serve solely to illustrate the technical details of the technology, which should not be narrowly interpreted within the limits of such embodiments and concrete examples, but rather may be applied in many variations within the spirit of the technology, provided such variations do not exceed the scope of the patent claims set forth below.

The invention claimed is:

1. A toner hopper for containing toner supplied from a toner container and for supplying the toner to a developing device, comprising:

a container tank for containing the toner;

a carrying screw having a shaft which is provided in the container tank and is rotated so as to carry the toner in the container tank; and an elastic member having a first section which is fixed to the container tank and a second section which comes into contact with the shaft of the carrying screw, the first section being provided farther from the carrying screw than the second section in a direction perpendicular to an axis line of the carrying screw.

2. The toner hopper according to claim 1, wherein:

the elastic member is made of a leaf spring; and the leaf spring is bent so that the second section presses against the shaft of the carrying screw.

3. The toner hopper according to claim 2, wherein the leaf spring has a strip shape and is attached to the container tank so that a long-side direction of the leaf spring and an axis line direction of the carrying screw are substantially parallel to each other.

4. The toner hopper according to claim 2, wherein the leaf spring is provided with a plurality of cuts made in a direction substantially perpendicular to an axis line direction of the carrying screw.

5. The toner hopper according to claim 2, wherein the leaf spring is made of metal or resin.

6. The toner hopper according to claim 2, wherein the leaf spring is made of polyethylene terephthalate.

7. The toner hopper according to claim 1, wherein the carrying screw has a rib formed on the shaft, the rib having a spiral shape.

8. The toner hopper according to claim 1, wherein:

due to rotation of the carrying screw, the toner flows upward and downward around the carrying screw while being carried; and the elastic member is provided not in a region in which the toner flows downward but in a region in which the toner flows upward.

9. A developing unit comprising a toner container, a developing device, and a toner hopper for containing toner supplied from the toner container and for supplying the toner to the developing device, the toner hopper comprising:

a container tank for containing the toner;

a carrying screw with a shaft which is provided in the container tank and is rotated so as to carry the toner in the container tank; and an elastic member having a first section which is fixed to the container tank and a second section which comes into contact with the shaft of the carrying screw, the first section being provided farther from the carrying screw than the second section in a direction perpendicular to an axis line of the carrying screw.

10. An image forming apparatus comprising a toner container, a developing device, and a toner hopper for containing toner supplied from the toner container and for supplying the toner to the developing device, the toner hopper comprising:

a container tank for containing the toner;

a carrying screw with a shaft which is provided in the container tank and is rotated so as to carry the toner in the container tank; and an elastic member having a first section which is fixed to the container tank and a second section which comes into contact with the shaft of the carrying screw, the first section being provided farther from the carrying screw than the second section in a direction perpendicular to an axis line of the carrying screw.

* * * * *